US012760953B2

(12) United States Patent
Pardee

(10) Patent No.: US 12,760,953 B2
(45) Date of Patent: Oct. 13, 2026

(54) HIGH POWER PASSIVE THERMAL STORAGE HEAT EXCHANGER

(71) Applicant: Jeffrey M. Pardee, King George, VA (US)

(72) Inventor: Jeffrey M. Pardee, King George, VA (US)

(73) Assignee: The United States of America, as represented by the Sec. of the Navy, Arlington, VA (US)

( * ) Notice: Subject to any disclaimer, the term of this patent is extended or adjusted under 35 U.S.C. 154(b) by 137 days.

(21) Appl. No.: 18/675,617

(22) Filed: May 28, 2024

(65) Prior Publication Data

US 2025/0369677 A1 Dec. 4, 2025

(51) Int. Cl.

| | |
|---|---|
| ***F25D 3/00*** | (2006.01) |
| ***F28D 20/02*** | (2006.01) |
| ***F28F 9/00*** | (2006.01) |
| *F28D 21/00* | (2006.01) |

(52) U.S. Cl.

CPC ..... *F25D 3/005* (2013.01); *F28D 20/021* (2013.01); *F28D 20/028* (2013.01); *F28F 9/005* (2013.01); *F28D 2021/0061* (2013.01)

(58) Field of Classification Search

CPC ..... F28D 20/02; F28D 20/021; F28D 2020/0082; F28D 2020/0091; F28D 20/025; F28D 20/026; F28D 20/0034; F25D 3/005; F24F 5/0021; F28F 9/165; F28F 2230/00

See application file for complete search history.

(56) References Cited

U.S. PATENT DOCUMENTS

| | | | | |
|---|---|---|---|---|
| 3,447,603 | A * | 6/1969 | Jones | F28F 9/04 165/69 |
| 4,270,523 | A * | 6/1981 | van Heel | F28D 20/021 165/104.11 |
| 4,324,228 | A * | 4/1982 | Shippee | F24D 11/003 126/646 |
| 5,036,904 | A * | 8/1991 | Kanda | F28D 20/021 165/104.11 |
| 5,220,954 | A * | 6/1993 | Longardner | F28D 20/021 165/104.11 |
| 6,196,296 | B1 * | 3/2001 | Wisniewski | F25D 31/006 165/47 |
| 2011/0271953 | A1 * | 11/2011 | Wortmann | F28D 20/0039 220/721 |
| 2012/0037148 | A1 * | 2/2012 | Tudor | F28D 20/02 126/400 |
| 2012/0241120 | A1 * | 9/2012 | Hagel | B60H 1/00492 165/10 |
| 2012/0279679 | A1 * | 11/2012 | Soukhojak | F28D 20/026 165/10 |
| 2016/0290216 | A1 * | 10/2016 | Katragadda | F01P 9/00 |
| 2020/0284526 | A1 * | 9/2020 | Desgrosseilliers | F28D 1/0316 |

FOREIGN PATENT DOCUMENTS

| | | | | |
|---|---|---|---|---|
| WO | WO-2010008329 | A1 * | 1/2010 | F28D 20/021 |

* cited by examiner

*Primary Examiner* — Jianying C Atkisson
*Assistant Examiner* — For K Ling
(74) *Attorney, Agent, or Firm* — NSCDD-OOL

(57) ABSTRACT

A heat exchanger that includes a vessel, a cooler within the vessel, the cooler includes a smooth cylindrical interior wall, a cover that seals the vessel, and, a cooling medium filling a portion of the interior of the cooler, wherein the cooler includes sufficient volume to allow the cooling medium to expand during a phase change from a liquid to a solid.

15 Claims, 4 Drawing Sheets

HIGH POWER PASSIVE THERMAL STORAGE HEAT EXCHANGER

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to thermal management systems. In particular, a high power passive thermal storage heat exchanger.

SUMMARY

According to an aspect, a high power passive thermal storage heat exchanger includes a cooler within a vessel with a cover. The cooler is partially filled with a phase change cooling medium which allows the cooling medium to expand as it changes phases from a liquid to a solid. The cooler further includes a smooth cylindrical interior wall which allows the cooling medium to expand along the walls during the phase change. In another aspect, the cooler further includes a flexible expansion cap which allows the volume of the cooler to increase or decrease as needed to compensate for the expansion and contraction of the cooling medium as it changes phases, as well as compensating for the expansion and contraction of the air in the cooler due to temperature change. In another aspect, the cooler includes fins on an exterior surface to maximize the surface areas, thus facilitate the efficient transfer of heat from the flow to the cooling medium. In another aspect, the vessel is a vacuum insulated flask.

In another aspect the heat exchanger further includes an inlet and outlet to fluidly connect to a thermal management system. The thermal management includes a sensing device that redirects a flow to the heat exchanger when a temperature of the flow exceeds above a base temperature. In another aspect, the thermal management system includes a heater, a pump, and a mixing valve. In another aspect, the mixing valve senses the increased temperature. In another aspect, the thermal management system includes a chiller fluidly connected to the thermal management system to recharge the cooling medium in the heat exchanger.

In another aspect, the phase change material is water, a glycol water mix, a paraffin, fatty acids, or a PEG. In another aspect, the phase change material is organic.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Figure 1:
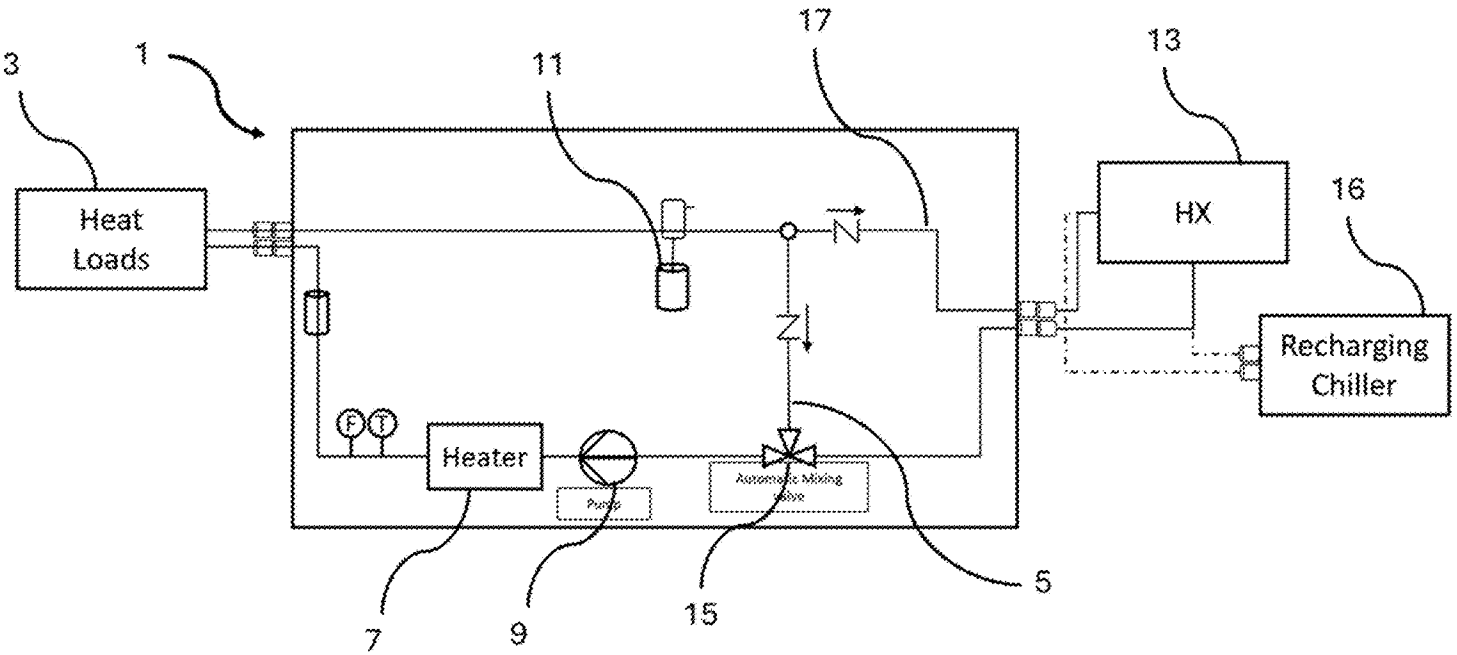
FIG. 1 is a schematic of a thermal management system.

FIG. 1 is a schematic of a thermal management system 1 used to control a heat load 3. Under normal conditions, the temperature of the heat load is controlled using a flow 15 is directed by mixing valve 5 to flow through a heater 7 and a pump 9, and the heat load 3. Additionally, the thermal management system may include an expansion tank 11 to compensate for the pressure changes. When the temperature of the heat load exceeds normal conditions, the temperature of the heat load 3 is controlled by using the mixing valve 5 to direct flow 17 to heat exchanger 13. Additionally, when the heat exchanger 13 requires recharging, a recharging chiller 16 is used to lower the temperature of the heat exchanger 13. Additionally, the thermal management system may include a flow sensor F and a temperature sensor T to control the pump and the mixing valve.

Figure 2:
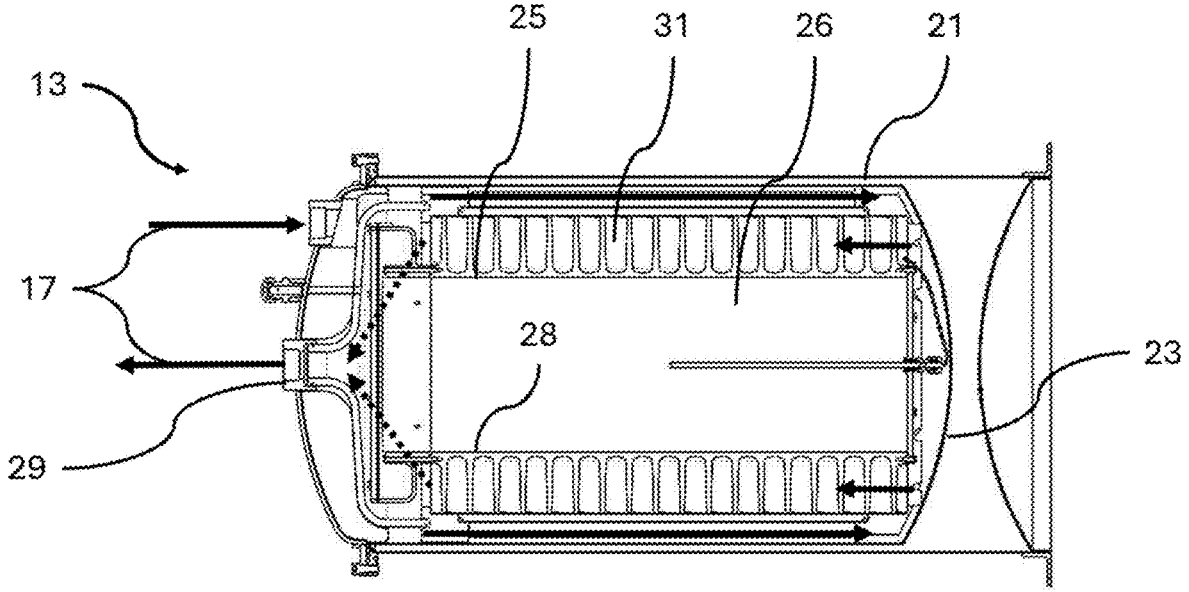
FIG. 2 is a schematic of the heat exchanger.

FIG. 2 shows a schematic of the heat exchanger 13. The heat exchanger 13 includes an outer vessel 21, an inner vessel 23, a cooler 25, and a cooling medium contained in a cavity 26 of defined by the cooler 25. The vessel 21 includes an inlet 27 and an outlet 29 to allow the flow 17 from the thermal management system to enter and exit. As shown in this embodiment, the flow enters inlet 21 between the outer vessel 21 and an inner vessel 23, then the flow continues between the inner vessel 23 and the cooler 25. In some embodiments, the cooler may include a series of fins 31 to increase the surface area of the cooler to maximize heat transfer between the flow 17 and the cooling medium 26. In other embodiments, the surface area may be increased by ridges, foils or plates.

Figure 3:
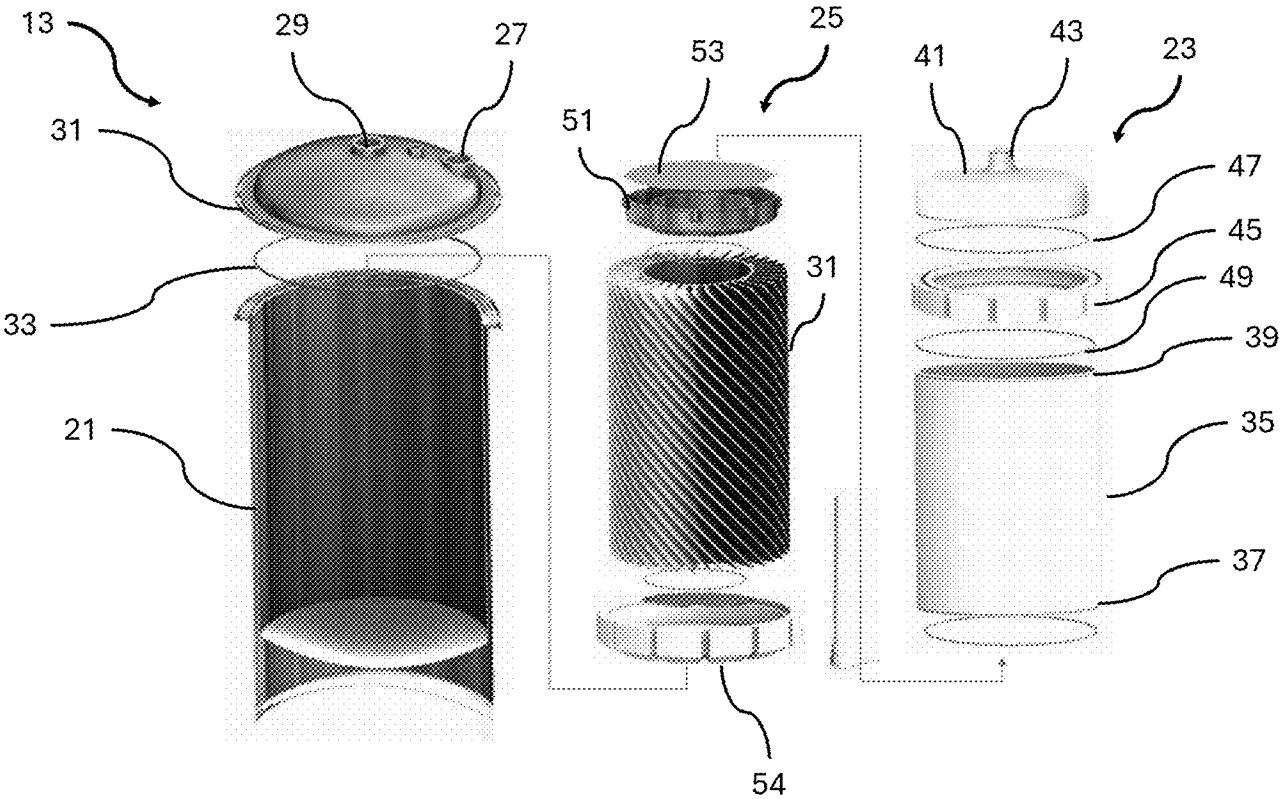
FIG. 3 is an assembly view of the heat exchanger.

FIG. 3 is an assembly view of the heat exchanger 13. As shown, the heat exchanger 13 includes an outer vessel 21 with a cover 31 that includes an inlet 27 and an outlet 29. In some embodiments, the outer vessel 21 is a vacuum insulated flask. In some embodiments, a gasket 33 may be used to create a seal between the outer vessel 21 and the cover 31. The heat exchanger 13 may further include the inner vessel 23. The inner vessel 23 is used to direct the flow 17 from the inlet 27 to the outlet 29. In some embodiments, the inner vessel 23 includes a cylindrical body 35. In some embodiments, the cylindrical body 35 includes an open end 37 distal from the inlet 27 and a closed end 39 proximate to the outlet 29. In the embodiment shown, the closed end 39 is closed using a cap 41. The cap 41 includes an opening 43 that is fluidly connected to the outlet 29. In the embodiment shown, the cap 41 is fixed to the cylindrical body 35 by a connector 45 and is sealed using gaskets 47, 49. In other embodiments, the inner vessel 23 may be a unibody incorporating both the cylindrical body 35 and the cap 41. Further, the heat exchanger includes a cooler 25. In the embodiment shown, the cooler 25 has an outer surface with fins 31 to increase heat exchange by increasing the surface area of the cooler 25. The cooler 25 includes an internal cavity 26. The internal cavity 26 contains a phase change cooling medium that is isolated from the flow 17. The internal cavity 26 includes an internal cylindrical wall 28. The cylindrical wall 28 is smooth which allows the phase change material to slide against the wall as it changes phases from a liquid to solid. If the walls are not smooth, the phase change material may fracture the cooler because the phase change material may create a mechanical bond with the non-smooth surface as it expands from a liquid to solid. For example, when water changes from a liquid to a solid the volume of the water increases by 9-10%. By making the internal wall smooth, the ice will slide along the smooth internal wall and not fracture the cooler 25. The cooler 25 further includes an expansion cap 51 to allow the volume of the internal cavity 26 to change as required by the changing volume of the phase change material as it transitions from one state (solid, liquid, or gas) to a different state (solid, liquid, or gas), well as compensating for the expansion and contraction of the air in the cooler due to temperature change. The expansion cap 51 may work in conjunction with flexible seal 53, which acts as a diaphragm, to allow the volume of the internal cavity 26 to fluctuate and prevents the cooler from fracturing due to the increased volume of the phase change material. The cooler 25 may further include a base 54 used to keep the outer vessel 21, the inner vessel 23, and the cooler 25 fixed relative each other to allow flow 17 to travel from the inlet 27 to outlet 29.

Figure 4A:
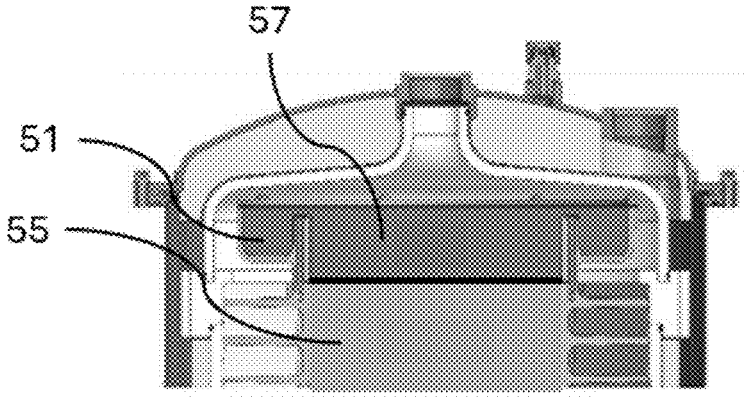
FIG. 4A-C is a view of the expansion cap at each stage of the phase change of the phase change material.
Figure 4B:
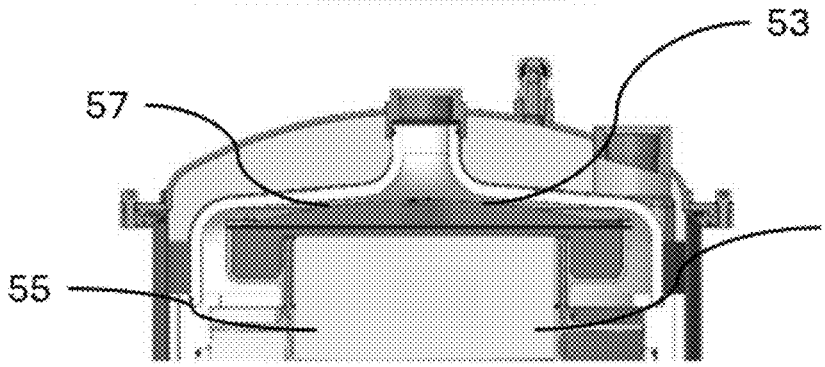
Figure 4C:
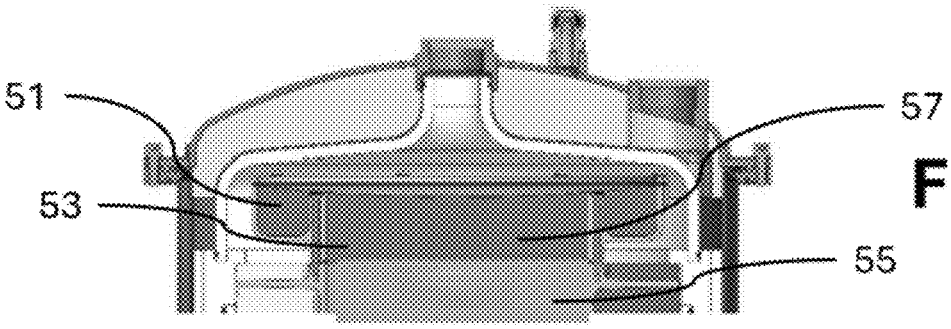

FIG. 4A-C is a view of the expansion cap 51 at different phases of the phase change material. In the shown embodiment, the phase change material is water. As shown in FIG. 4A, at the top of the figure page, the temperature of the water 55 is at 200 degrees Fahrenheit (200 F). In this embodiment, the volume of air 57 is 84 $in^3$. In FIG. 4B, in the middle of the figure page, the temperature of the water 55 is at 32 F and as the volume of water expands as it changes to ice, the volume of air decreases to 63 $in^3$ and the flexible seal 53 bows outward to compensate in the increase of overall volume of the air and water. In FIG. 4C, at the bottom of the figure page, the temperature of the water 55 is at 105 F and flexible seal bows inward to compensate in the decrease of overall volume of the air and water.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. An apparatus comprising:

a heat exchanger further comprising:

an outer vessel;

an inner vessel within the outer vessel;

a cooler within the inner vessel, the cooler includes a smooth cylindrical interior wall;

a cover that seals the outer vessel; and a cooling medium filling a portion of the interior of the cooler;

wherein the cooler includes sufficient volume to allow the cooling medium to expand during a phase change from a liquid to a solid.

2. The apparatus of claim 1, further comprising a flexible expansion cap fixed to one end of the cooler proximate to the cover.

3. The apparatus of claim 1, wherein the heat exchanger further comprises an inlet and an outlet.

4. The apparatus of claim 2, wherein the heat exchanger further comprises a flexible seal on the expansion cap.

5. The apparatus of claim 4, wherein the flexible seal is a rubber sheet.

6. The apparatus of claim 1, wherein the cooling medium is a phase change material.

7. The apparatus of claim 1, wherein the cooler further comprises fins on an exterior surface of the cooler.

8. The apparatus of claim 1, further comprising a thermal management system fluidly connected to the heat exchanger wherein the thermal management system senses an increased temperature above a base temperature and redirects a flow to the heat exchanger.

9. The apparatus of claim 8, wherein the thermal management system further comprises:

a heater;

a pump; and a mixing valve that senses the increased temperature.

10. The apparatus of claim 9, wherein the thermal management system further comprises an expansion tank.

11. The apparatus of claim 1, wherein the outer vessel is a vacuum insulated flask.

12. The apparatus of claim 8, further comprising a chiller fluidly connected to the thermal management system to recharge the cooling medium in the heat exchanger.

13. The apparatus of claim 5, wherein the flexible seal is made of butyl rubber.

14. The apparatus of claim 6, wherein the phase change material is a material selected from the group consisting of water, glycol, paraffin, fatty acids, and PEG.

15. The apparatus of claim 6, wherein the phase change material is an organic phase change material.

* * * * *